United States Patent [19]

Schwappach

[11] 4,304,058

[45] Dec. 8, 1981

[54] COUPLING OF AN EXCAVATOR SHOVEL

[75] Inventor: Dieter Schwappach, Dortmund, Fed. Rep. of Germany

[73] Assignee: O&K Orenstein & Koppel Aktiengesellschaft, Berlin, Fed. Rep. of Germany

[21] Appl. No.: 121,608

[22] Filed: Feb. 14, 1980

[30] Foreign Application Priority Data

Feb. 16, 1979 [DE] Fed. Rep. of Germany ..... 2905925

[51] Int. Cl.[3] ..... E02F 3/70

[52] U.S. Cl. ..... 37/103; 414/723

[58] Field of Search ..... 37/103, 117.5, 118; 414/722, 723

[56] References Cited

U.S. PATENT DOCUMENTS

| | | | |
|---|---|---|---|
| 3,578,188 | 5/1971 | Drieschner | 37/103 X |
| 4,127,203 | 11/1978 | Arnold | 414/723 |
| 4,133,121 | 1/1979 | Hemphill | 414/723 X |
| 4,187,050 | 2/1980 | Barbee | 37/103 X |

FOREIGN PATENT DOCUMENTS

| | | | |
|---|---|---|---|
| 2255427 | 8/1975 | France | 37/103 |
| 659696 | 6/1979 | U.S.S.R. | 37/103 |

*Primary Examiner*—E. H. Eickholt

*Attorney, Agent, or Firm*—Martin A. Farber

[57] ABSTRACT

Articulation of an excavator shovel at a pivot point arranged at the free end of the stick. A cap is mounted on the free end of the stick, the cap facing the rear wall of the shovel. The surface of the cap defines a radius with a center point at the pivot point of the shovel. A scraper plate with a width corresponding to the width of the stick on the rear wall of the shovel facing the stick is arranged parallel to the upper edge of the bearing bracket and cooperates with the cap so that only a clearance which assures free passage is present between the cap and the scraper plate. The imaginary extension of the scraper plate intersects the radius of the cap at a point located on the upper flange of the stick.

10 Claims, 3 Drawing Figures

COUPLING OF AN EXCAVATOR SHOVEL

The present invention has as its object the pivotal connection of a excavating shovel to a pivot point arranged on the free end of the stick.

In the known developments of the pivotal connection of excavator shovels, a wedge-shaped space is formed as a result of the wedge-shaped construction of the stick and a similar contour of the bottom of the shovel facing the stick, which space is increased or decreased depending on the position of the shovel. If now, when operating with the equipment, material, for instance pieces of rock, become loose, and enter into the wedge-shaped space between the stick and the bottom of the shovel, stones, etc. which do not fall through the constricted passage are crushed between the shovel and the stick upon the actuation of the shovel so that a build-up of material can furthermore result. Due to the large forces which are exerted by the hydraulic cylinders which serve to actuate the shovel, the pivot bearing is subjected to very high stresses and there is furthermore the danger that stick and shovel will be damaged or destroyed.

The object of the present invention is to develop the articulation of a shovel which is turnable about the free end of the stick of an excavator shovel boom in such a manner that no material which has been thrown loose upon the operation of the excavator or material falling out of the shovel passes, into the vicinity of the pivot point between the back of the shovel and the upper flange of the stick facing said back, thus preventing the structure of the excavator equipment from being subjected to uncontrollable stresses and strains. In addition, the clamping of material within the region extending up to the very top edge of the back of the shovel and the opposite region of the stick is to be substantially avoided.

This purpose is achieved in accordance with the invention in the manner that a cap is arranged on the free end of the stick, said cap facing said rear wall of the shovel which is articulated at the pivot point, the envelope of the cap having a radius the center of which lies at the pivot point, and in the manner that a scraper plate, which corresponds to the width of the stick, on the rear wall of the shovel which faces the stick, cooperates with the cap so that there is present between the cap and the scraper plate only sufficient clearance to assure free passage of the shovel, the imaginary extension of the scraper plate, which is arranged parallel to the upper edge of the bearing bracket, intersecting the radius of the cap at a point located on the upper flange of the stick.

With the above and other objects and advantages in view, the present invention will become more clearly understood in connection with the detailed description of a preferred embodiment, when considered with the accompanying drawings, of which:

Figure 1:
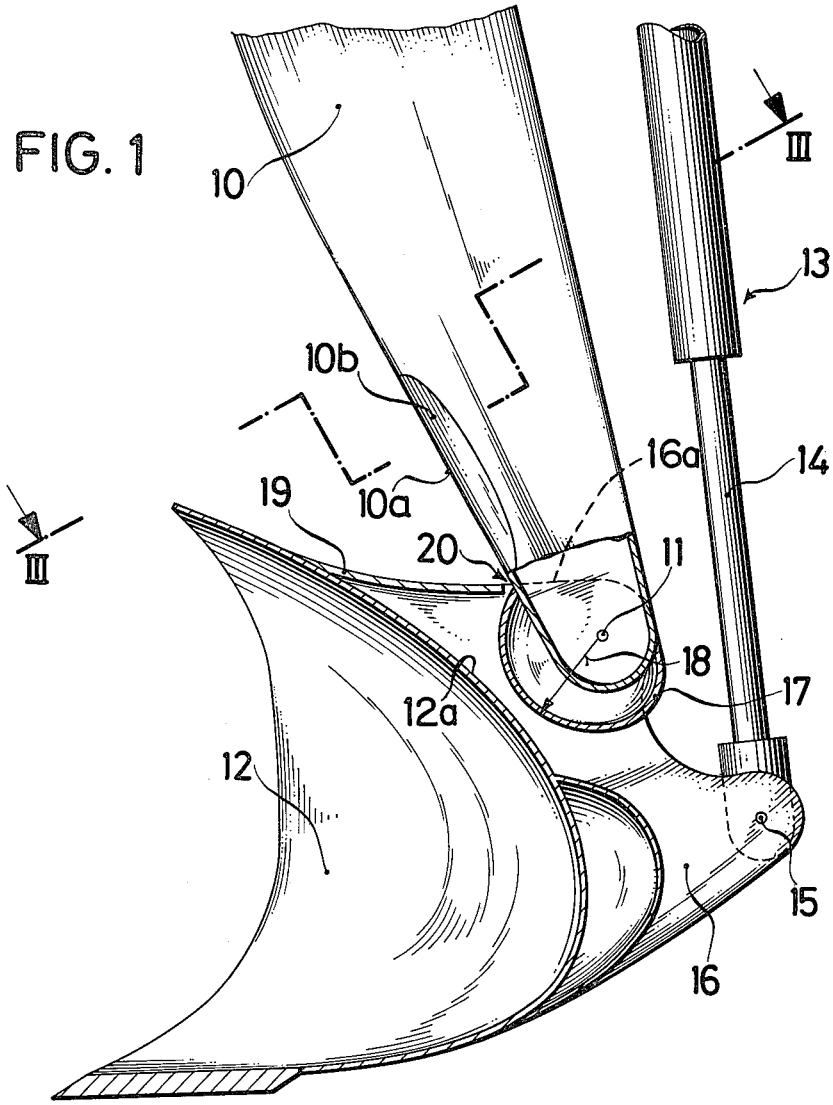
FIG. 1 is a side view with partial section, of an upward tilted excavator shovel, the actuating cylinder being extended.
Figure 2:
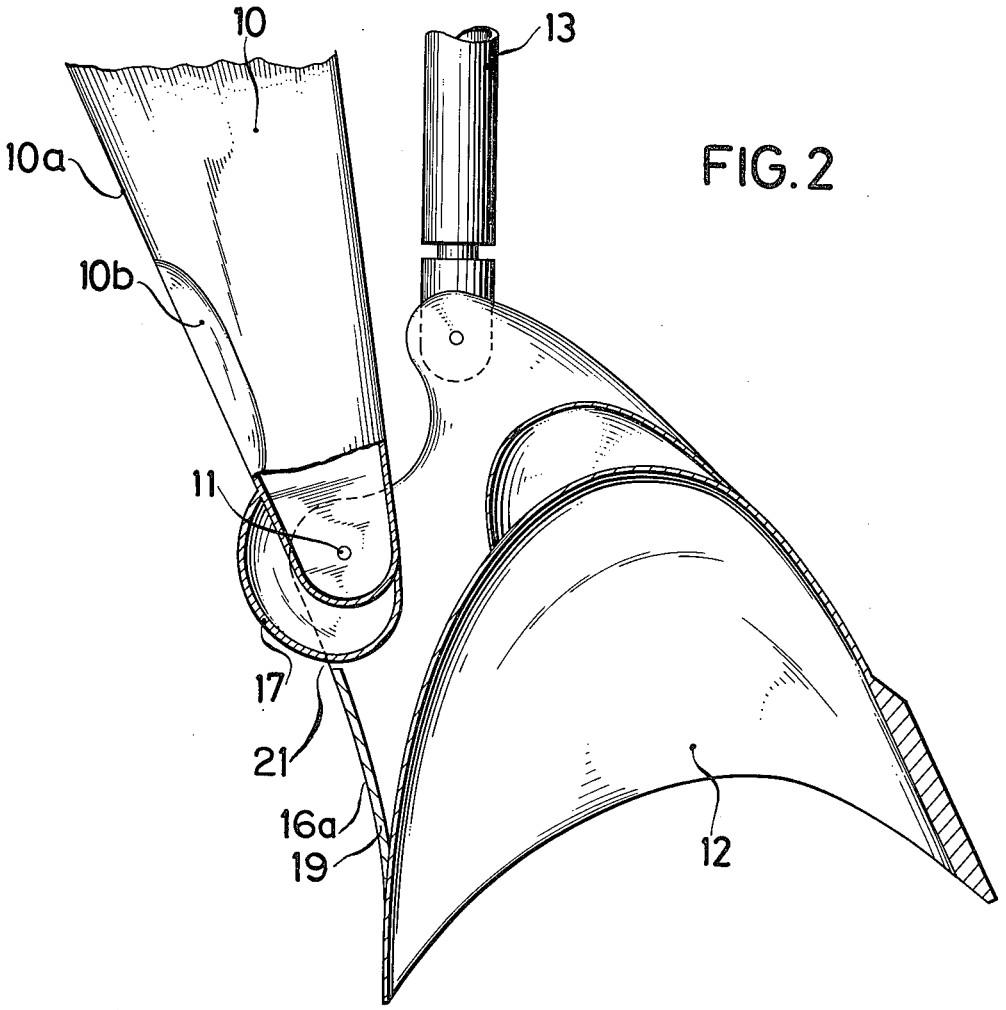
FIG. 2 is a side view similar to FIG. 1 with the shovel in downward tilted condition.
Figure 3:
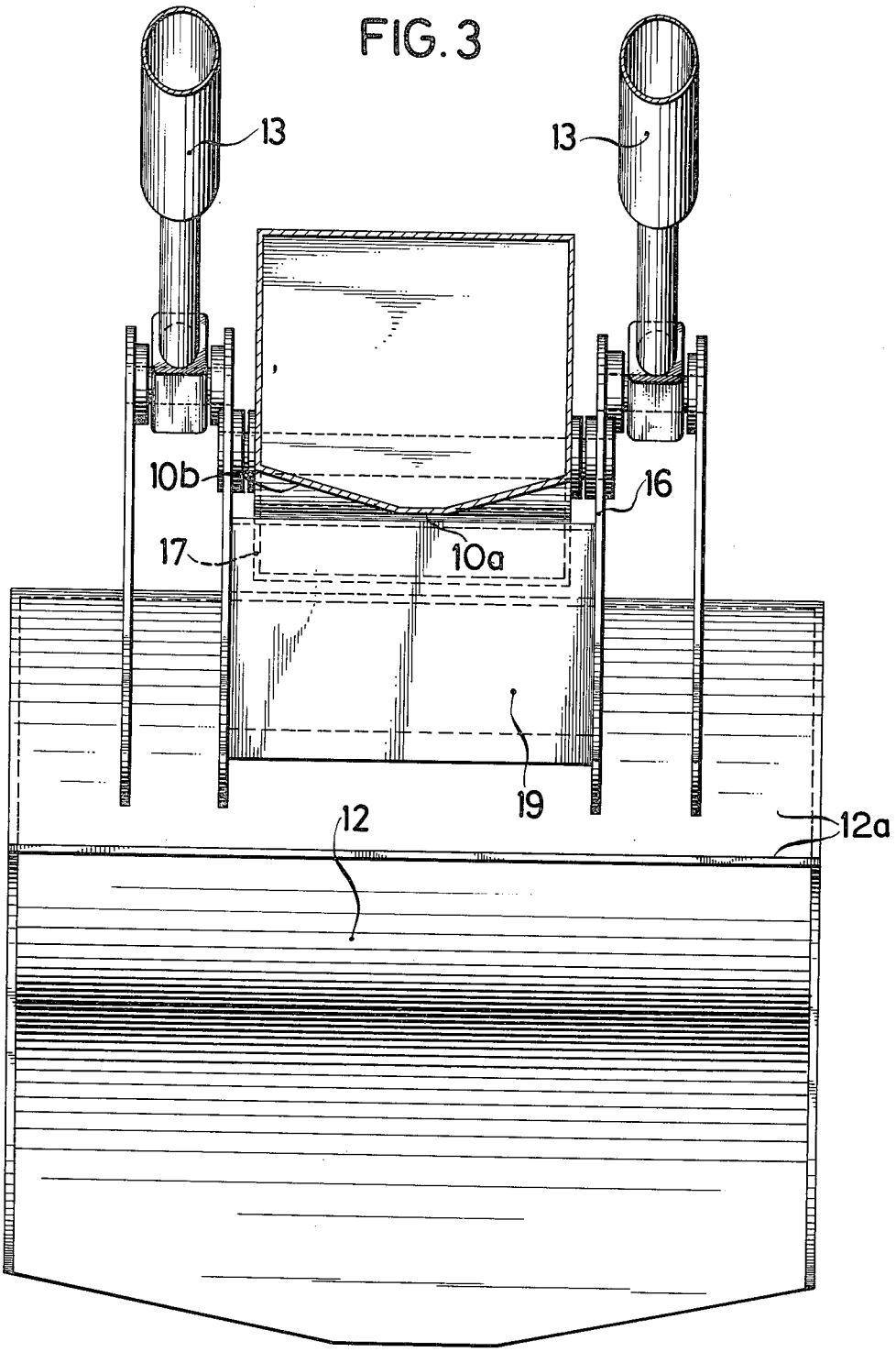
FIG. 3 is a section through the end of the stick above the pivot point, with a view of the shovel along the line III—III of FIG. 1 in the direction indicated by the arrow.

On the free end of the stick 10 of a excavator boom (not shown), the shovel 12 is pivotally articulated at the pivot point 11, the shovel being actuated by means of a hydraulic cylinder 13 in the manner that the piston rod 14 acts at the pivot point 15 which is arranged in the bearing bracket 16, which is rigidly connected to the shovel 12. The free end of the stick 10 is surrounded by a semi-circular cap 17. The radius 18 of the cap 17 is so selected that it strikes at a point 20 on the upper flange **10*a* of the stick 10 at which the imaginary extension of a scraper plate 19, arranged fastened along the upper edge 16*a* of the bearing bracket 16, intersects the upper flange 10*a* of the stick 10. The scraper plate 19 is so arranged on the back of the shovel 12 and along the upper edge of the bearing bracket 16 that it covers the width of the stick 10 and extends so far towards the stick 10 that only a slot 21 which assures free passage upon the swinging of the shovel 12 around the pivot point 11 remains. If the shovel 12 is turned around the pivot point 11 by the hydraulic cylinder 13, the scraper plate 19 closes off, over the entire region, the space between the stick 10 and the back 12*a* of the shovel 12 so that, upon operation, downward falling material (stones, ore and the like) cannot fall into said space. The upper flange 10*a* of the stick 10 is provided in the region thereof facing the shovel 12 with inclined surfaces 10*b* which slope away from the shovel towards both sides from its longitudinal center line so that material falling onto the upper flange 10*a*** slides off.

The invention is not limited to the embodiments shown in the drawings. The imaginary extension of the scraper plate 19 can intersect the upper flange **10*a* of the stick 10 also above or below the point 20 where the semicircle 18 of the cap 17 comes against the upper flange 10*a***.

What is claimed is:

1. An articulation of an excavator shovel, comprising a shovel having a back wall and a bearing bracket having an upper edge, a stick having a free end and articulated to said bearing bracket at a pivot point arranged at the free end of said stick, said stick having an upper flange above said pivot point, a cap mounted on said free end of said stick, said cap faces the back wall of said shovel, said cap having a surface defining a radius with a center located at said pivot point, said surface of said cap meets said upper flange at a meeting point, a scraper plate having a width substantially corresponding to the width of said stick is disposed at the back wall of said shovel mounted parallel to said upper edge of said bearing bracket, facing said stick and said cap on the latter, said scraper plate has a free end substantially touching but spaced from said cap defining only a clearance between said cap and the free end of said scraper plate which assures free passage of said shovel during pivoting about said pivot point, an imaginary extension of said scraper plate intersecting the radius of said cap adjacent said meeting point on the upper flange of said stick at a position of said shovel pivoted relative to said stick.

2. The articulation of an excavator shovel according to claim 1, wherein said upper flange of said stick on a region of said stick facing said shovel is formed with inclined surfaces, said inclined surfaces slope away from said shovel toward both sides from a longitudinal center line of said stick.

3. The articulation of an excavator shovel according to claim 1, wherein said imaginary extension of said scraper plate intersects said cap at said meeting point on said upper flange in said position of said shovel.

4. The articulation according to claim 1, wherein said imaginary extension of said scraper plate intersects said upper flange of said stick above said meeting point of the surface of said cap with said upper flange in said position of said shovel.

5. The articulation of an excavator shovel according to claim 1, wherein said imaginary extension of said scraper plate intersects said upper flange of said stick below said meeting point of the surface of said cap with said upper flange in said position of said shovel.

6. The articulation of an excavator shovel according to claim 1, wherein said surface of said cap is semi-circular about said pivot point from said meeting point to a lowermost portion of said cap.

7. The articulation of an excavator shovel according to claim 1, wherein said cap has a width substantially corresponding to said scraper plate.

8. The articulation of an excavator shovel according to claim 1, wherein said bearing bracket includes two spaced apart facing portions, said scraper plate extends between said two spaced apart facing portions.

9. The articulation of an excavator shovel according to claim 2, wherein said stick and said cap have straight edges at said meeting point, said edges extend the entire width of said stick and said cap and are parallel to a pivot axis of said shovel defined by said pivot point.

10. The articulation of an excavator shovel according to claim 1, wherein said position is an uppermost pivoted position of said shovel relative to said stick.

* * * * *